US006901669B1

(12) United States Patent
Liberatore

(10) Patent No.: US 6,901,669 B1
(45) Date of Patent: Jun. 7, 2005

(54) HAIR CLIPPER PROTECTIVE AND IDENTIFYING CAP

(76) Inventor: Shari Liberatore, 10818-A Downey Ave., Downey, CA (US) 90241

( * ) Notice: Subject to any disclaimer, the term of this patent is extended or adjusted under 35 U.S.C. 154(b) by 0 days.

(21) Appl. No.: 10/774,840

(22) Filed: Feb. 9, 2004

Related U.S. Application Data

(60) Provisional application No. 60/446,176, filed on Feb. 10, 2003.

(51) Int. Cl.[7] ..... B26B 19/48
(52) U.S. Cl. ..... 30/540; 30/539
(58) Field of Search ..... 30/539, 540, 232, 30/286, 287, 43.92

(56) References Cited

U.S. PATENT DOCUMENTS 4,751,781 A * 6/1988 Szymansky et al. ..... 30/537
5,884,401 A * 3/1999 Eckardt ..... 30/44

* cited by examiner

*Primary Examiner*—Douglas D Watts
(74) *Attorney, Agent, or Firm*—Goldstein Law Offices P.C.

(57) ABSTRACT

A hair clipper protective and identifying cap that is used to cover the cutting portion of a standard hair clipper. The protective cap is shaped to accommodate the cutting portion of the hair clipper. The bottom edge of the cap has a lip that allows the cap to be securely attached to the clippers. When the cap is properly placed over the cutting portion, the lip extends around the housing top end, at a point just below the cutting portion. Labels are applied to the protective cap or imprinted thereon to indicate whether the clipper is clean or requires sanitizing, namely "Clean" and "Soiled".

2 Claims, 3 Drawing Sheets

HAIR CLIPPER PROTECTIVE AND IDENTIFYING CAP

CROSS REFERENCES AND RELATED SUBJECT MATTER

This application is a continuation of provisional patent application Ser. No. 60/446,176, filed in the United States Patent Office on Feb. 10, 2003.

BACKGROUND OF THE INVENTION

The invention relates to a hair clipper protective and identifying cap. In particular, the invention is a flexible plastic cap that is placed over the top end of the clippers in order to keep the clippers clean, covered, and to identify the clipper's status as "clean" or "soiled".

Hair clippers are often used when cutting a person's hair. The clippers are typically electrically charged, having a handle portion and a top cutting portion. The cutting portion comprises a bladed comb that serves to trim and shave hair close to the skin.

Clippers of this type are often used in beauty parlors and barber shops. The clippers serve to give a person a clean cut hair line or to remove excess hair below the hair line. In addition, these hair clippers are also utilized in homes. Because of the ease of use, the clippers are convenient for shaving a person's hair or maintaining a short hair style.

In an attempt to maintain sanitary work environments in beauty parlors and barber shops, articles have been established by the Bureau of Barbering and Cosmetology. These articles set forth regulations which a hair stylist is expected to follow to maintain clean instruments that are used on clients. Such articles include disinfection of all instruments prior to use and storage of all instruments in a clean and covered location. Further, the Bureau requires labeling of the receptacles in which the instruments are stored, said labeling indicating that the receptacles are clean and covered. Violations of these regulations by the hair stylist may result in a fine.

Because of the frequency with which electric hair clippers are used in a barber shop or beauty parlor, the clippers are usually kept upright in their charger. Thus, there exists a need for a protective cap that is quickly and easily positioned over the top end of the hair clippers. The cap serves to protect the cutting portion of the clippers from dust and bacteria. Further, in the event that the clippers are dropped on the floor, the cap prevents dirt from entering the cutting portion.

Besides protecting the clippers, the cap also aids the hair stylist in complying with the regulations established by the Bureau of Barbering and Cosmetology. The cap keeps the clippers clean and covered and may also have a label indicating that the clippers are clean.

SUMMARY OF THE INVENTION

In view of the foregoing disadvantages inherent in the prior art, the present invention provides an improved hair clipper protective and identifying cap. As such, the general purpose of the present invention, which will be described subsequently in greater detail, is to provide a new and improved hair clipper protective and identifying cap which has all the advantages of the prior art and none of the disadvantages.

To attain this, the present invention essentially comprises a hair clipper protective cap that is used to cover the cutting portion of a standard hair clipper. The protective cap is shaped to accommodate the cutting portion of the hair clipper. The bottom edge of the cap has a lip that allows the cap to be securely attached to the clippers. When the cap is properly placed over the cutting portion, the lip extends around the housing top end, at a point just below the cutting portion. Several such caps are provided wherein labels are applied onto the protective cap to indicate whether the clipper has been cleaned, namely "Clean" and "Soiled", or indicia permanently indicates the same.

It is an object of the invention to produce a hair clipper protective and identifying cap that covers the cutting portion of the clipper. Accordingly, the cap has a shape similar to the clipper cutting portion. The cap fits thereover and protects the cutting portion from dirt and bacteria.

It is a further object of the invention to produce a hair clipper protective and identifying cap that is easily and quickly secured over the clipper cutting portion.

It is a further object of the invention to produce a hair cutting protective and identifying cap that may be easily cleaned and will not break or crack if dropped. Accordingly, the cap is constructed from a pliable plastic material.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
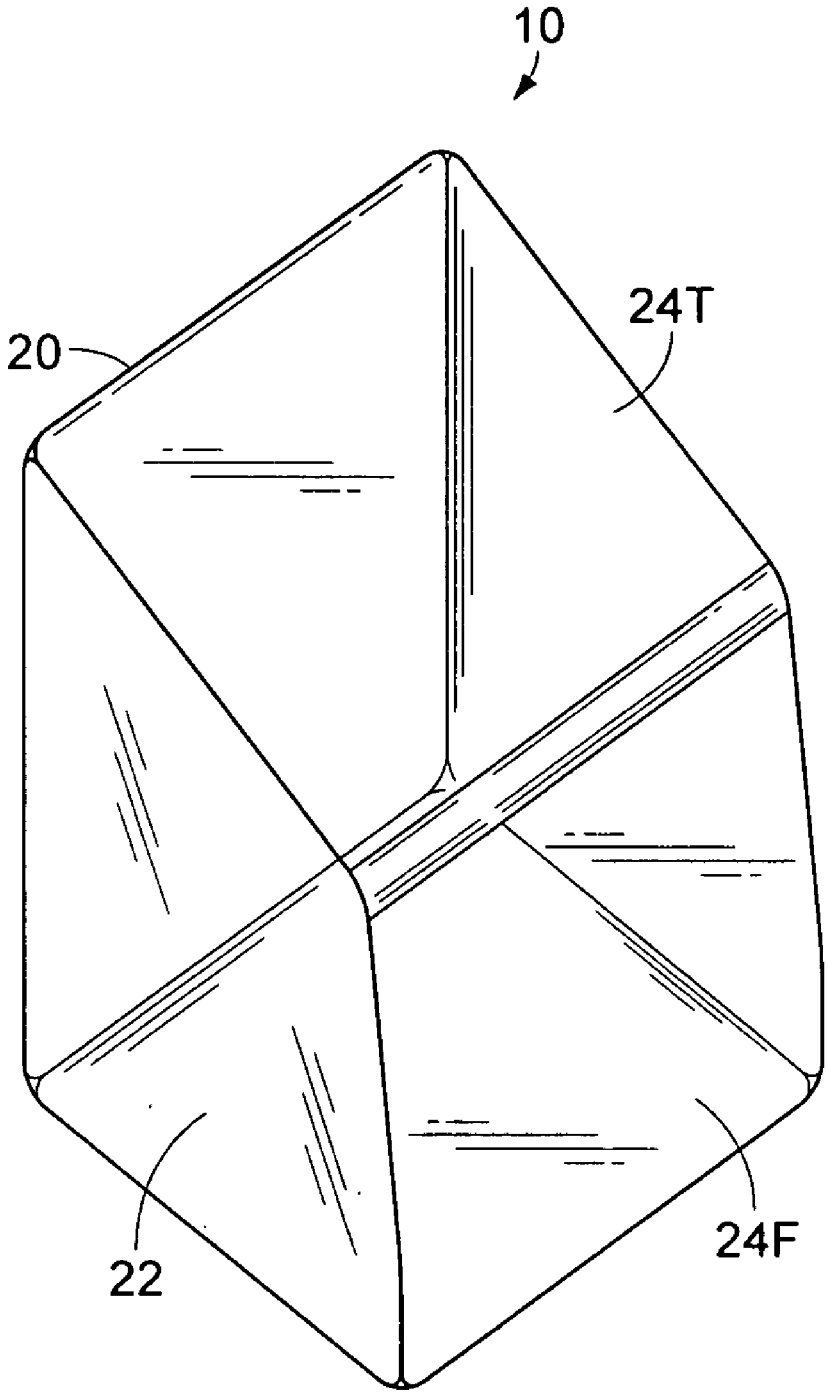
FIG. 1 is a perspective view of the hair clipper protective and identifying cap.

10 protective cap
12 hair clipper
14 clipper housing
14B housing bottom end
14T housing top end
16 clipper cutting portion
18 bladed comb
19 cap bottom edge
19L cap bottom edge lip
20 cap vertical rear wall
20T cap vertical rear wall top edge
22 cap side wall
22T cap side wall top edge
24 cap front wall
24F cap front wall front portion
24T cap front wall top portion
26 label

DETAILED DESCRIPTION OF THE PREFERRED EMBODIMENTS

FIG. 1 illustrates a hair clipper protective cap 10 that is used with a standard hair clipper 12. The hair clipper 12 essentially comprises a housing 14 and a cutting portion 16. The housing 14 has a bottom end 14B and a top end 14T, wherein the cutting portion 16 extends upward from the housing top end 14T. The cutting portion 16 comprises a bladed comb 18 that angles downward toward the housing top end 14T.

The protective cap 10 essentially comprises a bottom edge 19, a vertical rear wall 20, a pair of opposed side walls 22, and an curved front wall 24. The vertical rear wall 20 has a top edge 20T. The front wall 24 has a vertical front portion 24F that extends into an angled top portion 24T. The front wall angled top portion 24T extends backward from the vertical front portion 24F to the rear wall top edge 20T. The side walls 22 extend between the rear and front walls 20, 24, each side wall 22 having an angled top edge 22T that conforms to the shape of the front wall 24. Thus, the four walls 20, 22, 24 form an enclosed cap that fits snuggly over the cutting portion 16 of the hair clippers 12, accommodating the angled bladed comb.

The protective cap 10 may be used to cover any type of electric hair clipping instrument. Thus, the cap may be available in a variety of sizes to accommodate different clippers.

Figure 2:
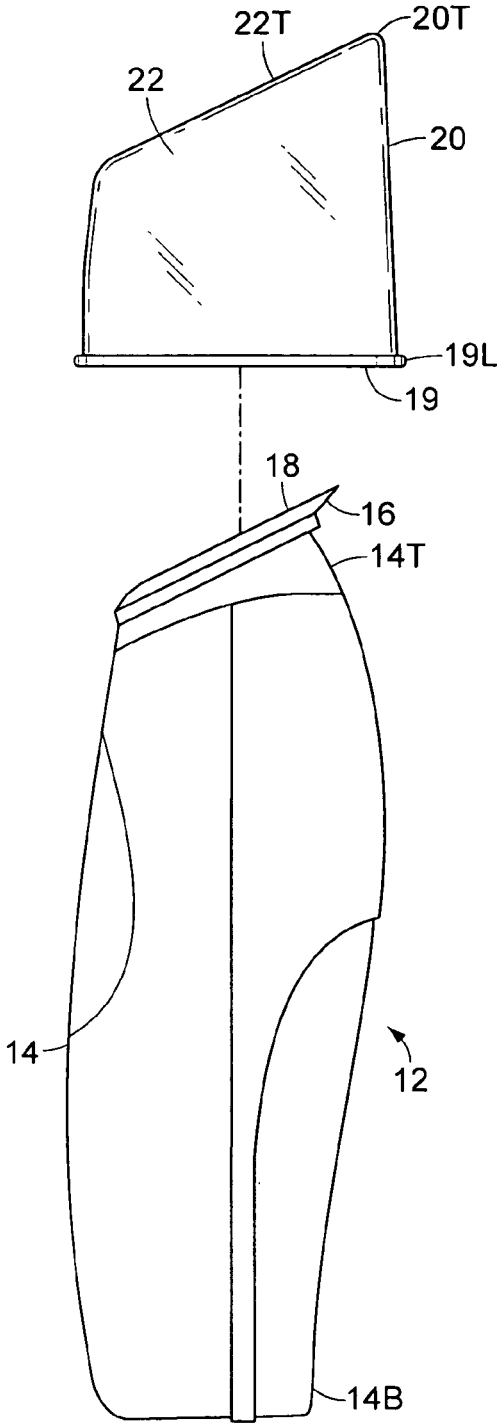
FIG. 2 is a side view of the cap, with the hair clipper in broken lines.
Figure 3:
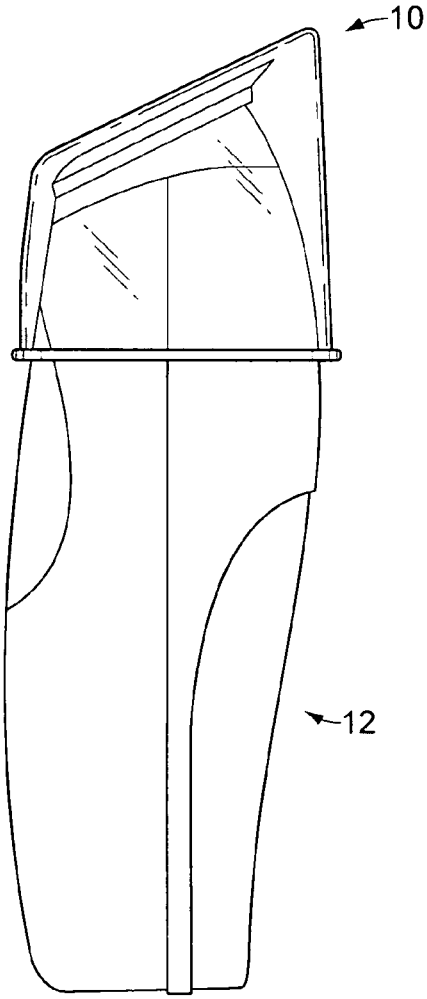
FIG. 3 is a side view of the cap in place over the hair clipper, with the hair clipper shown in broken lines.

Referring to FIGS. 2 and 3, the bottom edge 19 of the protective cap 10 has a lip 19L that allows the cap 10 to be securely attached to the clippers 12. When the cap 10 is properly placed over the cutting portion 16, the lip 19L extends around the housing top end 14T, at a point just below the cutting portion 16.

The protective cap 10 is preferably constructed from a pliable plastic material. Such a material is easily cleaned and impenetrable by dirt, dust, and bacteria.

Figure 4:
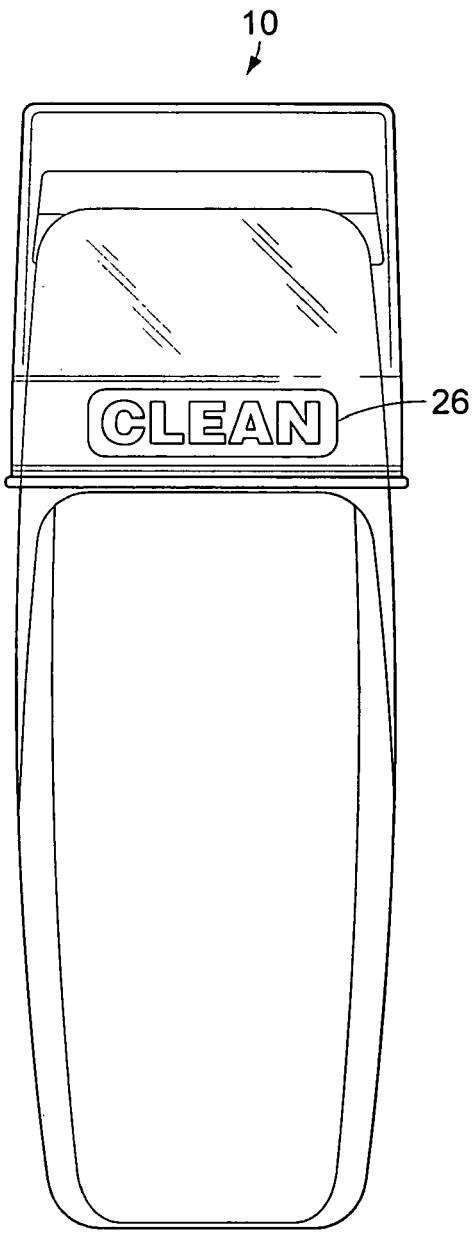
FIG. 4 is a front view of the cap in place over the hair clipper, with the hair clipper shown in broken lines, illustrating use of the "Clean" label.
Figure 5:
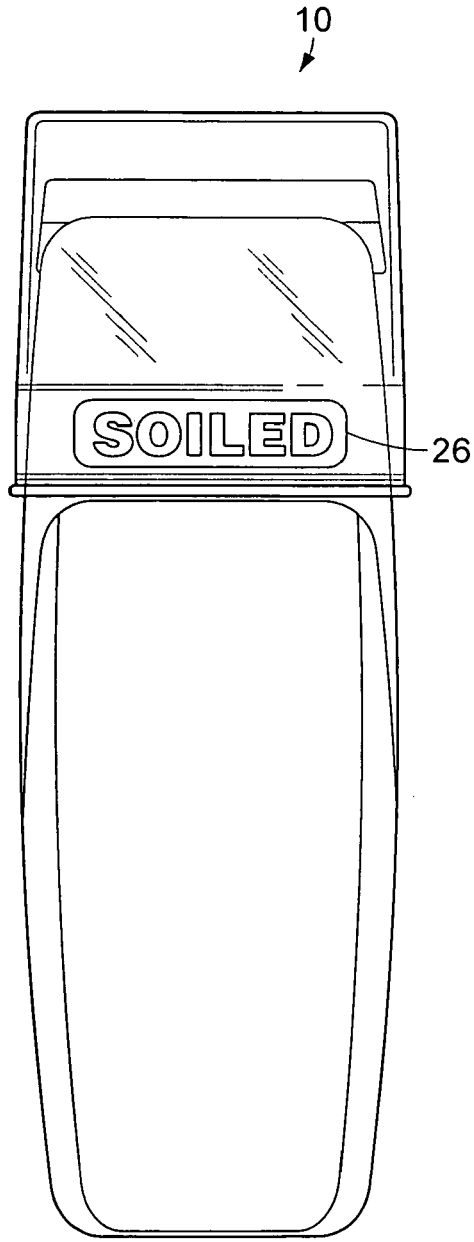
FIG. 5 is a front view of the cap in place over the hair clipper, with the hair clipper shown in broken lines, illustrating use of the "Soiled" label.

Additionally, as illustrated in FIGS. 4 and 5, indicia labels 26 may be applied to the protective cap 10 to indicate whether the clipper 10 has been cleaned, or has been used and is thereby dirty. Accordingly, the indicia labels read "Clean" and "Soiled". While the labels 26 may be applied to any of the walls, it is preferable that the label 26 be secured to the cap front wall 20 in order to be readily visible. Thus, when the protective cap reading "clean" is removed from the clipper, and the clipper is used to trim hair, the indicia label reading "soiled" is then applied to the front wall 20, and the cap 10 is replaced onto the clipper. Further, the labels 26 may be removed as necessary by peeling same from the cap 10.

Preferably, a set of protective caps 10 are provided, wherein at least one already has an indicia label reading "Soiled" and is placed over a clipper 12 after it has been used to trim hair, and at least one has an indicia label reading "clean" and is placed over a clipper 12 after it has been sanitized, or before initial use.

In conclusion, herein is presented a protective and identifying cap for covering the cutting portion of a hair clipper and indicating whether it is clean and ready for use, or it is dirty and must be sanitized. The invention is illustrated by example in the drawing figures, and throughout the written description. It should be understood that numerous variations are possible, while adhering to the inventive concept. Such variations are contemplated as being a part of the present invention.

What is claimed is:

1. A hair clipper protective and identifying method, for use with a hair clipper having a handle portion and a top cutting portion having an angled blade, using a protective cap having a front wall, rear wall, side walls, and an open bottom edge that together define an enclosed cap, and indicia labels, at least one of the indicia labels reading "soiled", and at least one of the indicia labels reading "clean", comprising the steps of:

applying the indicia label reading "clean" onto the front wall of the protective cap;

covering the angled blade of the clipper by extending the top cutting portion into the protective cap at the bottom edge;

removing the angled blade from the protective cap;

using the hair clipper to trim hair;

applying the indicia label reading "soiled" onto the front wall of the protective cap; and covering the angled blade of the clipper by extending the top cutting portion into the protective cap at the bottom edge.

2. A hair clipper protective and identifying method, for use with a hair clipper having a handle portion and a top cutting portion having an angled blade, using protective caps, each having a front wall, rear wall, side walls, and an open bottom edge that together define an enclosed cap, at least one of the caps has an indicia label reading "soiled", and at least one of the caps has an indicia label reading "clean", comprising the steps of:

covering the angled blade of the clipper with the protective cap having the indicia label reading "clean" by extending the top cutting portion into said protective cap at the bottom edge;

removing the angled blade from said protective cap;

using the hair clipper to trim hair;

covering the angled blade of the clipper with the protective cap having the indicia label reading "soiled" by extending the top cutting portion into said protective cap at the bottom edge.

* * * * *